United States Patent [19]

O'Connor

[11] Patent Number: 4,497,128

[45] Date of Patent: Feb. 5, 1985

[54] SINGLE-CHANNEL MICROFICHE MASTER

[75] Inventor: Mark O'Connor, Freeport, N.Y.

[73] Assignee: NB Jackets Co., Chicago, Ill.

[21] Appl. No.: 174,900

[22] Filed: Aug. 4, 1980

[51] Int. Cl.[3] ..... B42F 5/00

[52] U.S. Cl. ..... 40/405; 40/158 B; 40/159; 40/359; 40/124; 312/184

[58] Field of Search ..... 40/159, 158 R, 158 B, 40/405, 373, 374, 124.2, 124.4, 10 D, 124, 359; 206/455, 456, 806; 211/41, 50, 45, 175; 312/183, 184

[56] References Cited

U.S. PATENT DOCUMENTS

| | | | |
|---|---|---|---|
| 2,889,647 | 6/1959 | Roman | 40/159 |
| 3,336,690 | 8/1967 | Walter et al. | 40/158 R |
| 3,807,074 | 4/1974 | Owens et al. | 40/159 |
| 3,860,119 | 1/1975 | Irvine et al. | 312/184 X |
| 3,931,885 | 1/1976 | Nahill et al. | 312/184 |
| 4,178,844 | 12/1979 | Ward et al. | 211/175 |
| 4,193,218 | 3/1980 | Mermelstein | 40/158 B X |
| 4,274,216 | 6/1981 | Boyd | 40/124 |

FOREIGN PATENT DOCUMENTS

| | | | |
|---|---|---|---|
| 903038 | 12/1953 | Fed. Rep. of Germany | 40/158 B |
| 976155 | 3/1951 | France | 40/158 B |
| 1008601 | 5/1952 | France | 40/16.4 |
| 1516262 | of 1968 | France | 40/359 |

*Primary Examiner*—Gene Mancene
*Assistant Examiner*—James R. Hakomaki
*Attorney, Agent, or Firm*—Michael Ebert

[57] ABSTRACT

A single-channel microfiche master housing a strip of microfilm containing one or more frames of reduced scale images, the master being manipulatable in one axial direction only by optical readers and other microfiche-handling machines. The master is constituted by a rectangular tab having a pair of keyhole notches at spaced positions in the lower edge thereof and a single channel transparent jacket accommodating the microfilm strip, one end of the jacket being secured to the tab at a position intermediate the notches to form a T-shaped structure. The microfiche master may be stored in a standard pull-out drawer by a raised pair of rails which is bridged by the tab, the rails passing through the notches whereby the jacket is suspended therebelow in the drawer.

7 Claims, 6 Drawing Figures

Fig. 1.
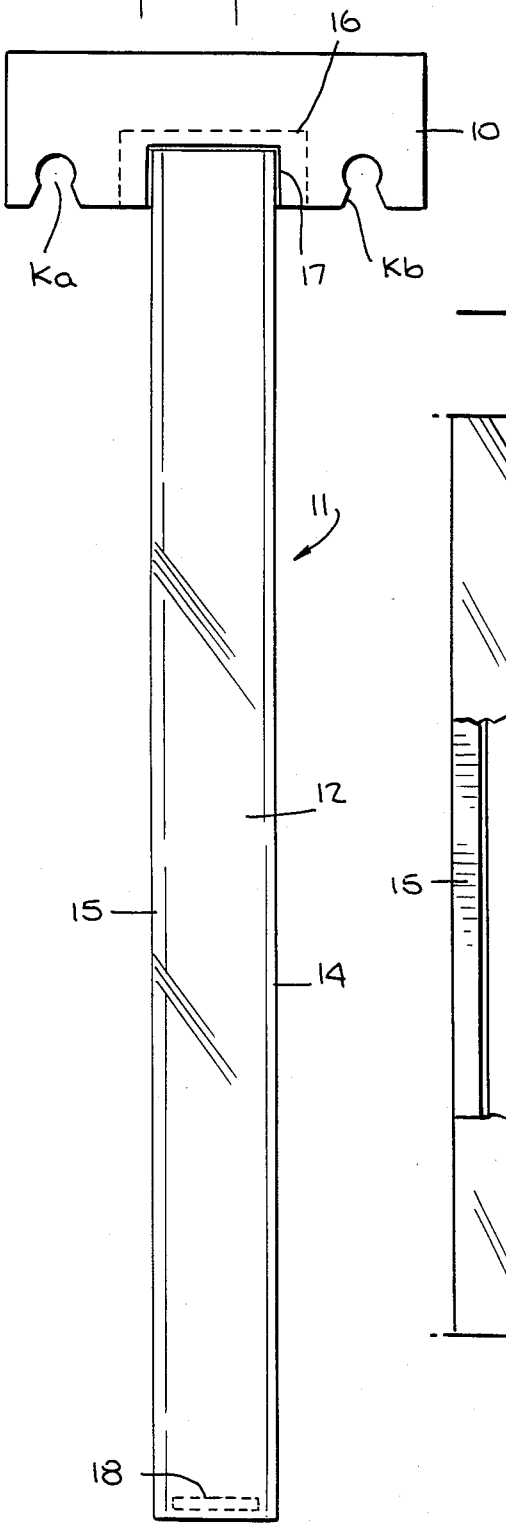
Fig. 3.
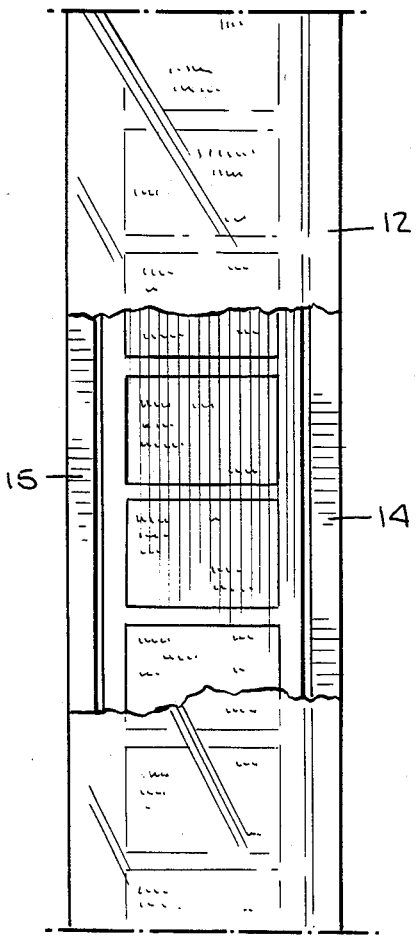
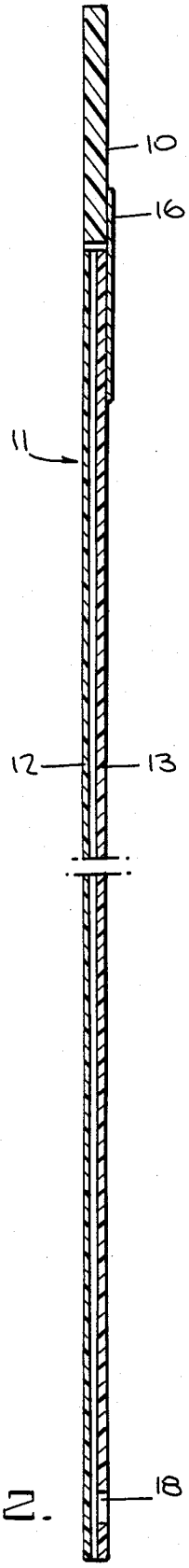
Fig. 2.

Fig. 4.
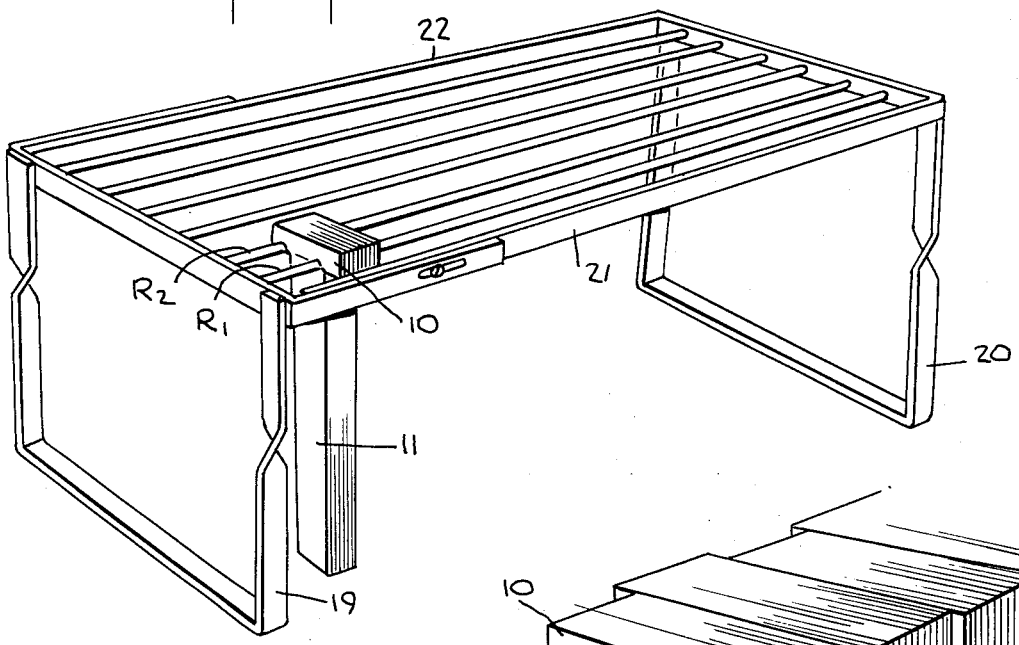
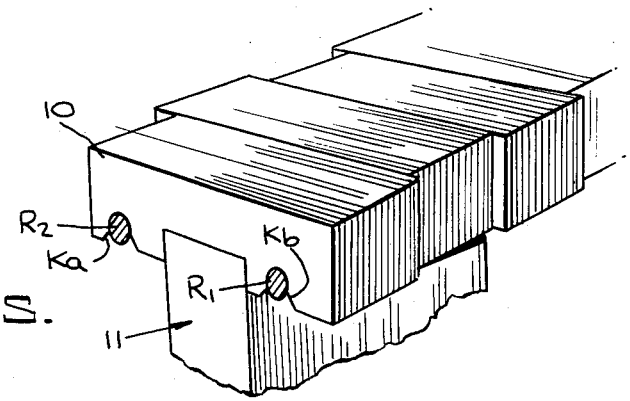
Fig. 5.
Fig. 6.
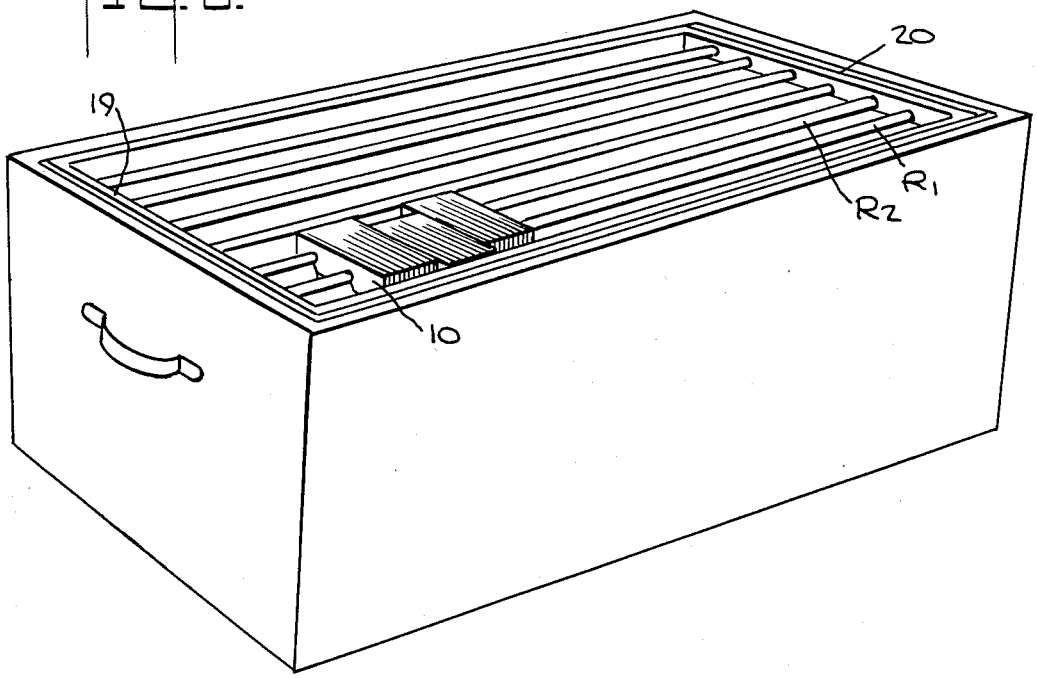

SINGLE-CHANNEL MICROFICHE MASTER

BACKGROUND OF INVENTION

This invention relates generally to microfiche masters adapted to accommodate microfilm, and more particularly to a single-channel microfiche master which is manipulatable in one axial direction only by a microfiche filler, reader, reader-printer or other microfiche-handling machine, the microfiche master lending itself to storage in standard file drawers and cabinets.

Microfiche masters housing 16 or 35 millimeter film are currently in widespread use in connection with the storage and retrieval of information photographically recorded on a reduced scale. One well-known form of microfiche master is disclosed in U.S. Pat. No. 3,238,655, the master being composed of two transparent plastic panels in superposed relation laminated together by parallel ribs which define a plurality of open-ended pockets or channels adapted to accommodate microfilm strips, each carrying one or more image frames of recorded text and other documentation.

The loaded multi-channel jacket functions as a microfiche master from which low-cost duplicates or reference copies can be quickly made by contact printing, using diazo-processing techniques for this purpose. A similar microfiche master is disclosed in U.S. Pat. No. 3,866,648, the multiple film-receiving channels in this instance being defined by parallel bonding lines formed by ultrasonically fusing the plastic panels together.

U.S. Pat. No. 3,238,655 and 4,167,842 disclose reader-filler machines for loading and updating a multi-channel microfiche jacket with film chips. Insertions are made by placing the jacket to be filled on an inclined platform that is shiftable in the Y-direction to register successive jacket channels with the leading edge of an incoming film web drawn from a reel, the film being guided in the X-direction along a trackway terminating adjacent the edge of the platform. In operation, a film section constituted by one or more image frames is advanced into a selected channel, the trailing edge of the section then being severed to form a film chip which remains in the channel. The platform is then indexed to the next channel for a new insertion.

To illustrate a typical microfiche system and the procedures involved in handling existing forms of multi-channel microfiches, we shall, by way of example, outline the procedures followed by the Black Bros. Company, as described in detail in the May 1976 issue of the *Modern Office Procedures* magazine. This company manufactures machines to perform laminating and finishing operations for wood and metal working and has some 20,000 machines in use throughout the world. To provide efficient and expeditious part service from inventory, it is essential that the records on each of these machines be readily accessible, so that the complete history of any machine in the field can be reviewed even while talking to a customer on the phone.

To this end, Black Bros. maintain no paper files at all for their machine records. Whenever a machine is sold, the order therefor and the bill of materials are photographically recorded on 16 mm microfilm, with a 20 times reduction in scale. This film is loaded by means of a reader-filler machine into 4 by 6 inch microfiche jackets having five channels, each having a maximum capacity of 12 frames. The jacket lists the customer's name and the machine's size and serial number, the jacket being color-coded to indicate machine type. Thus each microfiche jacket is capable of storing in a reduced image scale 60 documents relevant to a particular machine.

Using a microfiche diazo printer and a diazo processor, Black Bros. make reference copies of each microfiche master for their scales and customer service departments as well as for their service center responsible for the geographic area in which the machine is located. Updates to existing machine histories, such as repairs, new parts and new owners are also microfilmed and inserted into the existing jacket by means of the reader-filler machine.

When a telephone call is received by a service expert at a Black Bros. facility regarding any one of the machines in the field, the expert pulls out from his file only the reference copy of the microfiche master for that machine, and he puts it in an optical reader on his desk. Thus the expert is in a position to review the history of the machine while conferring with the customer.

Similar microfiche procedures are carried out in hospitals which must maintain detailed up-to-date medical histories on each patient, and in other organizations which have similar record requirements. In all cases, the machines for mechanically loading the multi-channel microfiches, for optically reading microfiche masters or reference copies must have an X-Y coordinate capability. The reason for this is that the film frames housed in the microfiche lies in parallel channels to define a rectangular array of frames; hence in order to select a particular frame for examination, the microfiche must first be shifted in the machine in the Y-direction to locate the channel containing the frame, the microfiche then being shifted in the X or channel direction to locate the desired frame therein.

Because of this X-Y coordinate requirement, readers and other machines adapted to manipulate existing multi-channel microfiche formats are relatively complex mechanisms which operate at fairly slow speeds and are expensive to manufacture.

Another factor which renders the multi-channel microfiche format somewhat incompatible with modern office requirements is the storage arrangement dictated by the file card dimensions of the microfiche. The usal storage practice is to provide trays for the multi-channels jackets, a typical tray having a 1,000 jacket capacity. These jackets may be filed in straight numerical order or alphabetically. Color coding, notching and other coding techniques are used to prevent misfiling. In automatic filing systems, a multi-shelf arrangement is provided, each shelf supporting a large number of trays. The shelves are mounted on a turret that is rotatable to bring a selected shelf into line with a file clerk's work table.

A tray-shelf multi-channel microfiche filing system is appropriate in those office and factory situations where the files can be concentrated at a central storage station under the control of an operator whose function it is to locate a desired microfiche and to deliver it to the requesting party. But in modern offices, the trend is toward individual, semi-enclosed work stations, each having a desk provided with desk drawers, compartments and shelves and for storing operating equipment, such as typewriters and microfiche readers appropriate to the nature of the work to be carried out at the station. Because a work station is designed to afford the office or factory worker all of the files and equipment necessary for that worker to perform his assigned task, it is important that all available space at the station be efficiently utilized.

To illustrate the limitations of existing systems based on the multi-channel microfiche format, we shall, by way of example, assume a ten work station set-up at a large insurance company in which the clerk assigned to each station has responsibility for 20,000 accounts whose records are contained in 20,000 multi-channel microfiles. This would ordinarily require 20 microfiche trays each holding 1,000 microfiches. With the typical work station, there may not be adequate room for 20 trays; for this would pre-empt an excessive amount of shelf or drawer space.

In this example, one could solve the space problem by centralizing the files for the ten work stations at a nearby central file room so that when a need arises for a particular account-record, the work station clerk would request the microfiche from file central. But this procedure has obvious practical drawbacks. Ideally, the files needed at each work station should be kept in a standard file drawer of the type presently used for letter or legal size folders so that the station clerk could have immediate access thereto.

However, while such file drawers are included in existing types of work stations for storing folders, the format of the multi-channel microfiche is such as to militate against use of such drawers for microfiche storage. Thus if a file tray containing multi-channel microfiches were kept in a drawer, in order to pull out a particular microfiche from the file, it would be necessary to remove the entire tray from the drawers and place it on the desk so that the operator could riffle through the file to locate the desired microfiche.

The present invention provides a single-channel microfiche format which facilitates the handling of microfiches. The need for a single-channel microfiche has been stimulated by the recent introduction of complete document microfilming machines designed for office use that are as simple to operate as a conventional office xerographic copier. Typical of such microfilming machines is the table model 6100 machine marketed by Electro-Optical Mechanisms, Inc. of Pomona, Calif. This machine is a microfilm processor that produces a 16 mm fully-processed film strip of six inches in length having up to 14 images thereon reduced to one twenty-fourth the original document size. Thus the operator, very much in the fashion of an office copier, succesively places documents of up to $8\frac{1}{2}\times 14$ inches in size in the machine. The machine takes reduced-scale photocopies of these documents on film which is automatically processed, advanced and cut to yield a single microfilm strip.

While such film strips can be inserted into the multiple channels of existing types of microfiche jackets, it would require a relatively expensive filler-reader machine having an X-Y coordinate capacity for this purpose. Moreover, since the 14-image capacity of the strip produced by the model 6100 machine is intended to provide a complete account or client record for use by doctors, dentists, lawyers, personnel departments and other users whose record requirements per account rarely exceed 14 documents, what is appropriate to a 14 frame microfilm strip is a single-channel jacket capable of housing this strip, rather than an existing multi-channel jacket whose channels each have the usual 12-frame capacity.

SUMMARY OF INVENTION

In view of the foregoing, the main object of this invention is to provide a single-channel microfiche master housing a single strip of microfilm containing one or more frames of reduced-scale images of documentation, the microfiche master providing a viewable and reproducible record of the documentation.

A significant advantage of a single-channel microfiche master in accordance with the invention is that the master and reference copies made therefrom may be manipulated in optical readers and other machines adapted to operate in a single axial direction only, thereby facilitating more rapid handling and simplifying the construction of such machines and reducing the size and cost thereof. Thus a microfilm storage and retrieval system based on the single-channel microfiche master may take advantage of the present availability of office microfilming machines which produce low-cost microfilm strips of documentation. With a single-channel microfiche format, one can create a far less expensive and more efficient information storage and retrieval system suitable for law and medical offices and in similar facilities which cannot, as a practical matter, make use of existing multi-channel microfiche systems because of their high cost and complexity. Moreover, the microfilming machine makes possible rapid updating of the single-channel microfiche masters which make up the system.

Also an object of the invention is to provide a single-channel microfiche master which lends itself to storage in standard letter and legal-size file drawers whereby thousands of such masters may be stored in a single pull-out drawer. It becomes feasible, therefore, at a work station provided with an optical reader for the station operator to have immediate and convenient access to all records relevant to his assignment without having to consult a remote filing facility each time the need arises for a record.

The advantages gained by a single-channel microfiche master are not limited to the improved storage capability of such microfiches, for all aspects of a storage and retrieval system based on this format are expedited and simplified by reason of their mono-axial handling requirement, thereby obviating the need for machines having X-Y coordinate capabilities.

Briefly stated, these objects are attained in a single-channel microfiche master housing a strip of microfilm containing one or more frames of reduced scale images of documentation, the master being manipulatable in one axial direction only by optical readers and other microfiche-handling machines having this limited capability.

The master, which has a T-shaped configuration, is constituted by a rectangular tab having a pair of keyhole notches at spaced positions in the lower edge thereof, and a single-channel transparent jacket for accommodating the microfilm strip, one end of the jacket being secured to the tab at a position intermediate the notches.

The microfilm master may be stored in a drawer by a raised pair of rails which is bridged by the tab, the rails passing through the notches whereby the jacket is suspended therebelow. In order to distinguish between different sets of masters supported on the rails, such as sets each consisting of a hundred masters, the notches in one set may be laterally displaced relative to those in another set, so that each set occupies a distinct position on the rails.

OUTLINE OF DRAWINGS

For a better understanding of the invention as well as other objects and further features thereof, reference is made to the following detailed description to be read in conjunction with the accompanying drawings, wherein:

FIG. 1 is a front view of a single-channel microfiche master in accordance with the invention;

FIG. 2 is a longitudinal section taken through FIG. 1;

FIG. 3 is a cut-away portion of the single channel jacket included in the microfiche master;

FIG. 4 is a perspective view of a rack insertable in a standard file drawer to adapt the drawer to the storage of single-channel microfiches;

FIG. 5 shows the relationship to the rails of the rack of two sets of microfiche masters supported thereon, one set being offset with respect to the other; and FIG. 6 is another perspective view of the rack as seen from the side.

DESCRIPTION OF INVENTION

The Master

Referring now to FIGS. 1 to 3, there is shown a single-channel microfiche master in accordance with the invention, the master being composed of a rectangular tab 10 to which is attached a single-channel transparent jacket 11 for accommodating a microfilm chip. Jacket 11 may have a length sufficient to accommodate a six-inch, 16 mm microfilm strip of the type produced by the above-identified model 6100 machine which has a 14 image frame capacity. It is to be understood, however, that the jacket may be dimensioned to accommodate other microfilm sizes such as 35 mm, and that the length of the jacket may be greater or less than 6 inches. In practice, the length of the jacket depends on the depth of the storage drawer for which it is designed.

Tab 10 is preferably formed of a translucent, synthetic, plastic film material such as a polyester having a 10 mil thickness to impart rigidity to the tab, and having a printable surface, so that the identification of the record contained in the jacket and other information relevant to the record may be typed or written directly onto the tab. Tab 10 is provided with a pair of keyhole notches $K_a$ and $K_b$ punched into the lower edge thereof. The spacing between notches $K_a$ and $K_b$ corresponds to the spacing between a raised pair of rails for supporting the microfiche, which rails will be later described in the filing section of this specification. The translucency of the tab is essential for contact printing.

Jacket 11 is composed of two superposed transparent panels 12 and 13, the panels being formed of clear, flexible plastic material, preferably a polyester or Mylar film. Polyester material is advantageous because of its exceptional clarity, high strength and dimensional stability.

Interposed between the front and back panels and laminated thereto are parallel ribs 14 and 15 which define a pocket or channel open at either end. In practice, these ribs may be preformed of paper or plastic ribbon and adhesively bonded to the plastic panels, or they may be formed in situ by parallel streams of molten plastic material in the manner described in the copending Dorman application Ser. No. 792,109, filed Apr. 29, 1977, whose entire disclosure is incorporated herein by reference.

Preferably, front panel 12 is exceptionally thin (i.e., one mil or less) to facilitate contact printing, whereas back panel 13 is of heavier gauge material (3 to 5 mils) to impart body to the microfiche master, making it easier to handle.

To upper end of jacket 11 is secured to tab 10 at a position intermediate notches $K_a$ and $K_b$. A preferred means of attachment is a small piece of pressure-sensitive adhesive tape 16 adhered to the rear surface of the tab at the lower edge thereof between the keyhole notches. Tape 16 overlies a rectangular notch 17 in the tab whose width is slightly larger than the width of the jacket. Notch 17 serves to expose the pressure-sensitive adhesive layer on the tape, so that in attaching the upper end of the jacket to the tab, one has merely to press this end into the opening formed by notch 17. The invention is not limited to this type of attachment. In practice, the end of the jacket may be thermally or otherwise bonded to the tab without the use of pressure-sensitive adhesive.

To facilitate insertion of a microfilm strip or add-on chip 8 into the jacket, a rectangular slot 18 is cut across back panel 13 adjacent the input or lower end of the channel. Loading may be effected by a reader-filler machine of the type disclosed in the above-identified patents relating to such machines. However, because there is only one channel, there is no need for an X-Y capability, and use, therefore, may be made of simplified versions of these patented machines having an X-direction insertion capability only for the film.

The spacing between the front and back panels is determined by the ribs interconnecting these panels. The thickness of these ribs is made such as to be substantially equal to the thickness of the microfilm to be inserted in the channel, so that the film is snugly received therein.

In a reference copy or duplicate made from a microfiche master in accordance with the invention, the copy film strip is adhered to a notched tab of the type illustrated herein, so that the resultant structure can be filed and handled in the same manner as the microfiche master.

Filing

Referring now to FIGS. 4 to 6, there is shown a rack which is adapted to store literally thousands of single-channel microfiche masters or microfiche copies in a single standard file drawer of letter and legal size. To this end, the rack is composed of front and rear rectangular metal frames 19 and 20 whose upper corners are joined together by expansible side bars 21 and 22, the dimensions of the rack being such that it fits within a standard drawer or cabinet, the rack being expanded or contracted, as needed, to accommodate itself to the length of the drawer.

Extending longitudinally between the upper beams of the front and rear frames 19 and 20 are three parallel pairs of round rails, $R_1$ and $R_2$, the spacing between the rails in each pair corresponding to the space between keyhole notches $K_a$ and $K_b$ on the microfiches, making it possible to snap the tabs onto the rails.

In practice, in order to facilitate the location of a desired microfiche in a straightforward numerical filing system, the microfiches are produced in sets of 100 each, which are received in the rails, the distinction between successive sets being established, as shown in FIG. 5, by cutting the notches in successive sets at displaced positions so that the sets are alternately offset on the rails. To further facilitate indexing and prevent misfiling, the microfiches may be color-coded or notch-coded in the manner presently employed with multi-channel microfiches.

Because the single-channel microfiches may be stored in a standard pull-out drawer which can house thousands of such records, it becomes possible in a single drawer, say, in a law or medical office, to store the records of all clients and patients therein and to obtain access to any record simply by pulling out the drawer and selecting the record from the file.

One problem often encountered with conventional microfiches stacked within a file tray is "blocking"; that is, the tendency of the microfiches to stick together. As a consequence of blocking, the locating and removal of particular microfiches become a more difficult operation. In the present invention, blocking is obviated by closely maching the dimensions of the notches in the tabs to the dimensions of the rails for supporting the tabs so that each microfiche master stands up in the file rack and yet is readily slidable along the rails. To facilitate movement, the rails are preferably of smooth or polished metal. Thus each microfiche master on the rails is an independent element not subject to blocking and is easily manipulated by a file clerk or other operator.

A filing system based on a single-channel microfiche in accordance with the invention can be used to advantage with existing document microfilming machines which yield a fully processed film strip having a series of image frames thereon. Such office machines lend themselves to rapid updating operations in conjunction with the microfiche filing system; for if there are, say, 12 documents which represent updated information to be added to five single-channel microfiche masters representing different accounts, all 12 documents can be microfilmed by the office machine on a common strip which is then cut into chips to be inserted into the appropriate masters.

While there has been shown and described a preferred embodiment of a single-channel microfiche master in accordance with the invention, it will be appreciated that many changes and modifications may be made therein without, however, departing from the essential spirit thereof.

I claim:

1. A single-channel microfiche master for housing a strip of microfilm having a predetermined width and having a series of image frames thereon, and updating add-on film chips of the same width, said master being reproducible by contact printing to provide reference copies, said master comprising:

a rectangular tab having a pair of notches cut into the lower edge thereof at spaced positions, said tab being bridgeable across a pair of notch-receiving rails; and a jacket formed by superposed front and rear panels of transparent plastic material interconnected by prallel ribs to define a single channel having a width substantially equal to said predetermined width for accomodating the microfilm strip and said add-on chips, said front panel being thinner than said rear panel to facilitate contact printing, one end of the jacket being secured to the tab at a position intermediate the notches, whereby the jacket and the tab form a T-shaped structure, one of the panels having a slot therein adjacent the free end of the jacket to permit endwise machine insertion of the strip and the chips into the channel.

2. A microfiche master as set forth in claim 1, wherein said tab is formed of translucent plastic material which is printable.

3. A microfiche master as set forth in claim 1, wherein said notches have a keyhole formation to render it receivable on round rails.

4. A microfiche master as set forth in claim 1, wherein said panels are formed of polyester material.

5. A microfiche master as set forth in claim 1, wherein said microfilm has a 16 mm size.

6. A microfiche master as set forth in claim 1, wherein said microfilm has a 35 mm size.

7. A microfiche master as set forth in claim 1, wherein said jacket has a length sufficient to accommodate a strip having a 6-inch length.

* * * * *

UNITED STATES PATENT OFFICE

CERTIFICATE OF CORRECTION

Patent No. 4,497,128 Dated February 5, 1985

Inventor(s) Mark O'Connor

It is certified that error appears in the above-identified patent and that said Letters Patent are hereby corrected as shown below:

Column 8, line 16: change "prallel" to --parallel--.

Signed and Sealed this

*Second* Day of *July 1985*

[SEAL]

*Attest:*

DONALD J. QUIGG

*Attesting Officer* *Acting Commissioner of Patents and Trademarks*